US008576534B2

(12) United States Patent
Choi

(10) Patent No.: US 8,576,534 B2
(45) Date of Patent: Nov. 5, 2013

(54) ELECTRONIC MAGNETIC CONTACTOR

(75) Inventor: Jae Hyuk Choi, Chungbuk (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 11 days.

(21) Appl. No.: 13/469,973

(22) Filed: May 11, 2012

(65) Prior Publication Data

US 2013/0021713 A1 Jan. 24, 2013

(30) Foreign Application Priority Data

Jul. 20, 2011 (KR) ..... 10-2011-0071782

(51) Int. Cl.
*H01H 47/00* (2006.01)

(52) U.S. Cl.
USPC ..... 361/160; 361/139

(58) Field of Classification Search
USPC ..... 361/139, 144, 160
See application file for complete search history.

(56) References Cited

U.S. PATENT DOCUMENTS

| | | | | |
|---|---|---|---|---|
| 2011/0019327 | A1* | 1/2011 | Graf et al. | 361/139 |
| 2011/0222200 | A1* | 9/2011 | Fuller et al. | 361/100 |

FOREIGN PATENT DOCUMENTS

| | | |
|---|---|---|
| JP | 63-062305 | 3/1988 |
| JP | 63-264837 | 11/1988 |
| JP | 05-166444 | 7/1993 |
| JP | 08-031288 | 2/1996 |

OTHER PUBLICATIONS

Japan Patent Office Application Serial No. 2012-113554, Office Action dated Jun. 4, 2013, 4 pages.

* cited by examiner

*Primary Examiner* — Danny Nguyen
(74) *Attorney, Agent, or Firm* — Lee, Hong, Degerman, Kang & Waimey

(57) ABSTRACT

Disclosed is an electronic magnetic contactor, the contactor including: an operation power supply unit inputting an operation power; an electronic switch driving unit receiving a power from the operation power supply unit to drive a power supply of a load; a switching unit switched by a pulse signal to drive the electronic switch driving unit; an operation state determination unit determining whether the electronic magnetic contactor is in an opened state or in a closed state; an input voltage sensing unit sensing an amplitude of an input voltage supplied from the operation power supply unit; and an input signal generation unit generating an input signal for determining whether the electronic magnetic contactor is inputted based on determined state by the operation state determination unit and the sensed amplitude by the input voltage sensing unit.

8 Claims, 5 Drawing Sheets

ELECTRONIC MAGNETIC CONTACTOR

CROSS REFERENCE TO RELATED APPLICATION

The present application is based on, and claims priority from, Korean Application Number 10-2011-0071782, filed on Jul. 20, 2011, the disclosure of which is incorporated by reference herein in its entirety.

BACKGROUND OF THE DISCLOSURE

1. Field of the Disclosure

The present disclosure relates to an electronic magnetic contactor, and more particularly to an electronic magnetic contactor having an operation state input.

2. Discussion of the Related Art

This section provides background information related to the present disclosure which is not necessarily prior art.

Generally, an electronic magnetic contactor, as one of constituent parts forming a factory automation system, serves to supply a power to a load or interrupt the power to the load, and to prevent a motor load from being burnt. The electronic magnetic contactor includes electronic elements including a thermal relay and an electronic magnetic switch, and a frame for assembling the electronic elements in one package. Furthermore, the electronic magnetic contactor functions to supply a power to a load or interrupt the load to the load in response to magnetization of an electromagnetic coil that is one of constituent parts of a switch.

In order to activate the electronic magnetic contactor, an inrush current is initially applied to an electromagnetic coil to activate a moving coil. In a case the moving coil is contacted to a fixed core, and even if a very weak holding current over the inrush current is applied to the electromagnetic coil, an electronic control is performed inside to maintain an operation state.

However, there may occur a problem of generating an inrush failure due to a capacity deficiency phenomenon of an operation power at the contactor at a time when the inrush current is applied to the electromagnetic coil of the electron magnetic contactor, voltage fluctuation by a starting load, drop in instantaneous voltage due to lightning or input of an excessive voltage. This problem is caused by supply of an input signal by sensing only amplitude of an input voltage at an electronic control device, which can cause a tremendous damage to the automation system. The conventional electronic magnetic contactor however cannot solve the problem because only an electromagnetic coil (60) is installed therein.

It is, therefore, desirable to overcome the above problems and others by providing an improved electronic magnetic contactor.

SUMMARY OF THE DISCLOSURE

This section provides a general summary of the disclosure, and is not a comprehensive disclosure of its full scope or all of its features.

The present disclosure is directed to cope with the above-mentioned problems/disadvantages and it is an object of the present disclosure to provide an electronic magnetic contactor configured to re-input a power by receiving a state of the electronic magnetic contactor.

Another object of the present disclosure is to provide an electronic magnetic contactor configured to minimize a potential loss that may occur at a factory management system by re-inputting a power, even if a discharge phenomenon occurs due to an external shock at a field site where vibration is severe. Technical problems to be solved by the present disclosure are not restricted to the above-mentioned description, and any other technical problems not mentioned so far will be clearly appreciated from the following description by the skilled in the art.

In a general aspect of the present disclosure, there is provided an electronic magnetic contactor, the contactor comprising: an operation power supply unit inputting an operation power; an electronic switch driving unit receiving a power from the operation power supply unit to drive a power supply of a load; a switching unit switched by a pulse signal to drive the electronic switch driving unit; an operation state determination unit determining whether the electronic magnetic contactor is in an opened state or in a closed state; an input voltage sensing unit sensing amplitude of an input voltage supplied from the operation power supply unit; and an input signal generation unit generating an input signal for determining whether the electronic magnetic contactor is inputted based on a determination result determined by the operation state determination unit and a sensing result sensed by the input voltage sensing unit.

Preferably, but not necessarily, the operation state determination unit includes a comparator outputting a high output in a case the electronic magnetic contactor is in an open state and outputting a low output in a case the electronic magnetic contactor is in a closed state.

Preferably, but not necessarily, the input voltage sensing unit compares amplitude of the input voltage supplied by the operation power supply unit with amplitude of a reference voltage to output a high output in a case the amplitude of the input voltage is greater than the amplitude of the reference voltage, and output a low output in a case the amplitude of the input voltage is smaller than the amplitude of the reference voltage.

Preferably, but not necessarily, the input signal generation unit includes a comparator for generating an input signal for determining whether the electronic magnetic contactor is inputted based on an OR gate for determining whether at least one high output is outputted in response to the determination result determined by the operation state determination unit and the sensing result sensed by the input voltage sensing unit, and an output of the OR gate.

Preferably, but not necessarily, the input signal generation unit generates an input signal instructing an input of the electronic magnetic contactor in a case at least a result of one high output is outputted in response to the determination result determined by the operation state determination unit and the sensing result sensed by the input voltage sensing unit.

Preferably, but not necessarily, the operation power supply unit includes a surge absorption unit absorbing a transient voltage, a noise filter circuit unit removing noise from an output power of the surge absorption unit, and a rectifying current circuit unit rectifying an output power from a noise filter and supplying the rectified power DC power to the switching unit.

Preferably, but not necessarily, the electronic magnetic contactor further comprises: an electromagnetic coil interposed between the operation power supply unit and the switching unit to be driven by switching of the switching unit; and a discharge circuit unit connected to the electromagnetic coil in parallel to allow a power condensed in the electromagnetic coil to continuously flow, in a case the switching unit is turned off.

Preferably, but not necessarily, the switching unit includes a pulse width modulation unit generating a pulse signal, in a case a power is supplied to a load, and a current sensing circuit unit detecting a current flowing to the switching unit and outputting the detected current to the pulse width modulation unit, wherein the pulse width modulation unit varies a width of the pulse signal in response to the pulse signal of the current sensing circuit unit.

The electronic magnetic contactor thus configured according to the present disclosure has an advantageous effect in that a power can be re-inputted by receiving a state of the electronic magnetic contactor, whereby a potential loss that may occur at a factory management system can be minimized by re-inputting the power, even if a discharge phenomenon occurs due to an external shock at a field site where vibration is severe.

BRIEF DESCRIPTION OF THE DRAWINGS

The accompanying drawings, which are included to provide a further understanding of the present disclosure and are incorporated in the present disclosure and constitute a part of this application, and together with the description, serve to explain the principle of the disclosure. In the drawings.

DETAILED DESCRIPTION

Figure 1:
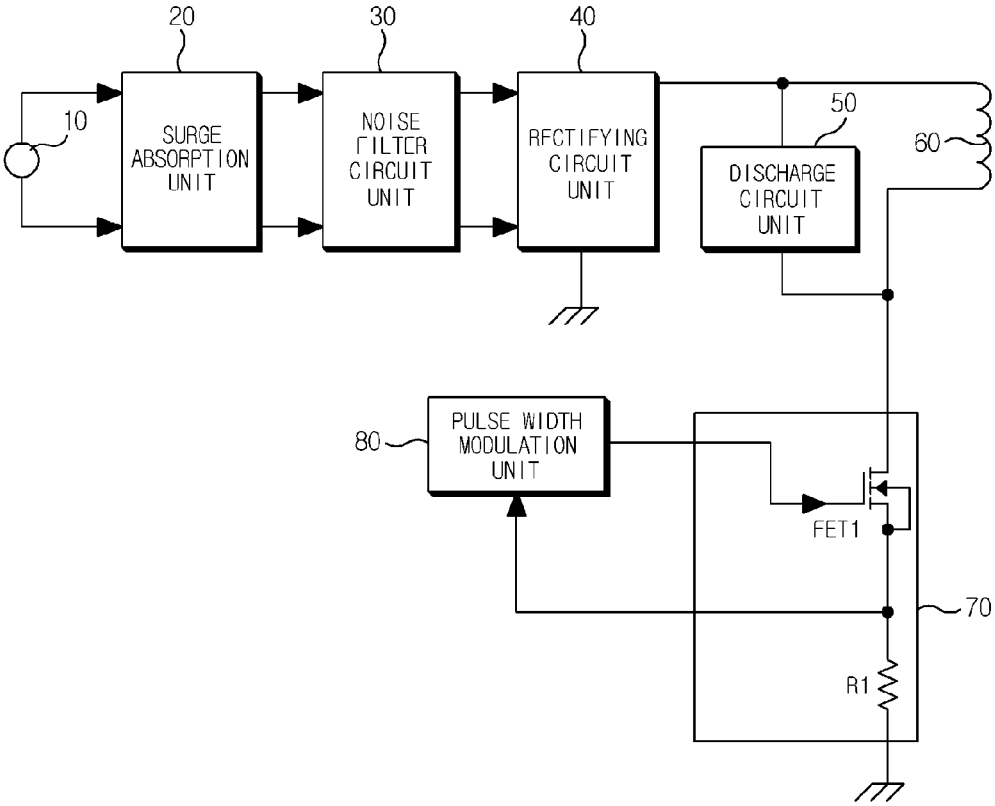
FIG. 1 (PRIOR ART)
FIG. 1 is a schematic block diagram illustrating a configuration of an electronic magnetic contactor according to prior art.

Advantages and features of the present invention may be understood more readily by reference to the following detailed description of exemplary embodiments and the accompanying drawings. Detailed descriptions of well-known functions, configurations or constructions are omitted for brevity and clarity so as not to obscure the description of the present disclosure with unnecessary detail. Thus, the present disclosure is not limited to the exemplary embodiments which will be described below, but may be implemented in other forms. In the drawings, the width, length, thickness, etc. of components may be exaggerated or reduced for the sake of convenience. Furthermore, throughout the descriptions, the same reference numerals will be assigned to the same elements in the explanations of the figures, and explanations that duplicate one another will be omitted.

Accordingly, the meaning of specific terms or words used in the specification and claims should not be limited to the literal or commonly employed sense, but should be construed or may be different in accordance with the intention of a user or an operator and customary usages. Therefore, the definition of the specific terms or words should be based on the contents across the specification. The terms "a" and "an" herein do not denote a limitation of quantity, but rather denote the presence of at least one of the referenced item.

As may be used herein, the terms "substantially" and "approximately" provide an industry-accepted tolerance for its corresponding term and/or relativity between items. Such an industry-accepted tolerance ranges from less than one percent to ten percent and corresponds to, but is not limited to, component values, angles, et cetera.

Now, an electronic magnetic contactor according to exemplary embodiments of the present disclosure will be described in detail with reference to accompanying drawings.

FIG. 1 is a schematic block diagram illustrating a configuration of an electronic magnetic contactor according to prior art.

A conventional electronic magnetic contactor includes a surge absorption unit (20), a noise filter circuit unit (30), a rectifying circuit unit (40), a discharge circuit unit (50), an electromagnetic coil (60), a switching unit (70) and a pulse width modulation unit (80). Reference numeral 10 is an operation power. The operation power (10) may be an alternating current (AC) power or a direct current power. The surge absorption unit (20) removes a surge voltage included in the operation power (10) by absorption.

The noise filter circuit unit (30) removes noise included in the operation power removed of the surge voltage by the surge absorption unit (20). The rectifying circuit unit (40) serves to rectify the power outputted from the noise filter circuit unit (30) and convert the rectified power to DC power. The discharge circuit unit (50) and the electromagnetic coil (60) are connected in parallel, and a terminal at one side of the parallel connection is connected to an output terminal of the rectifying circuit unit (40).

The pulse width modulation unit (80) generates a switching signal using a pulse signal having a predetermined width. The switching unit (70) is such that a gate of a transistor (FET1) is connected to a ground resistor (R1) to detect a current flowing on an output terminal of the pulse width modulation unit (80) and the electromagnetic coil (60), and a drain of the transistor (FET1) is connected to the parallel connected electromagnetic coil (60) and a terminal of the other side of the discharge circuit unit (50).

The electronic magnetic contactor thus configured is such that the surge absorption unit (20) absorbs the surge voltage from the inputted operation power (10), the noise filter circuit unit (30) filters the noise and removes the noise and the rectifying circuit unit (40) rectifies the surge voltage-absorbed, noise-removed power and outputs in DC power. At this time, in a case the power inputted as the operation power (10) is a DC power, the rectifying circuit unit (40) may be dispensed with.

In a case the power is supplied under this state, the pulse width modulation unit (80) generates a pulse signal with a predetermined width, and the generated pulse signal is applied to the gate of the transistor (FET1). The transistor (FET1) repeats a conducted state and an interrupted state in response to the pulse signal outputted by the pulse width modulation unit (80).

In a case the transistor (FET1) is in a conducted state, the output power of the rectifying circuit unit (40) flows to the ground via the electromagnetic coil (60) and the transistor (FET1). In a case the transistor (FET1) is in an interrupted state, the output power condensed in the electromagnetic coil (60) flows through the discharge circuit unit (50). Thus, the electromagnetic coil (60) keeps the excited state, whereby the electronic switch of the electronic magnetic contactor keeps the closed state to allow the power to be supplied to the load.

Figure 2:
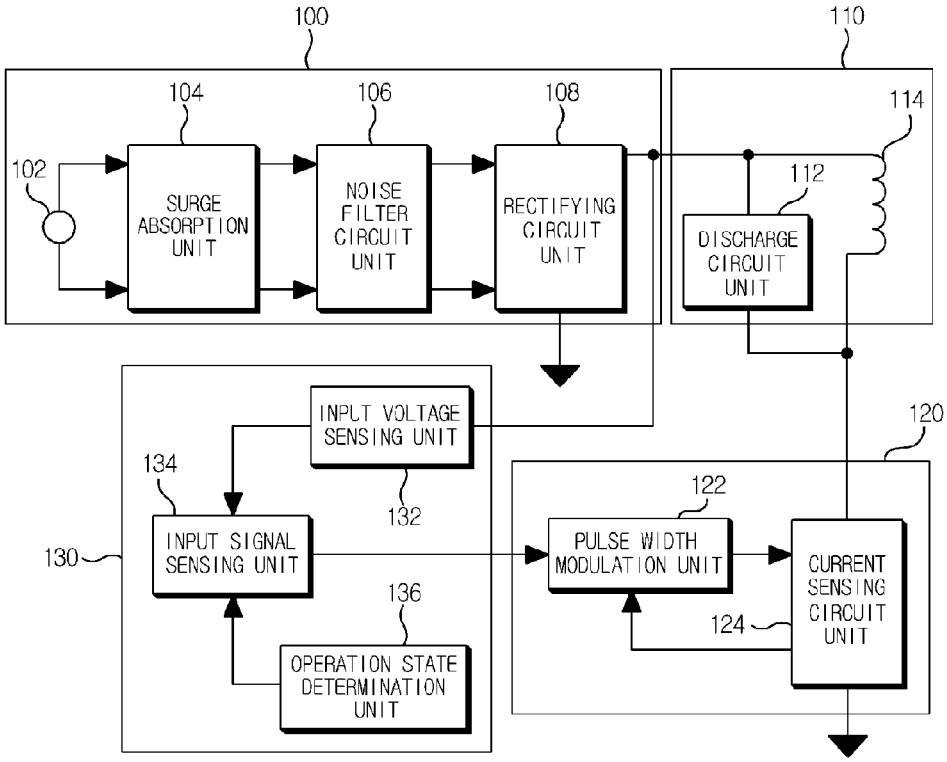
FIG. 2 is a schematic block diagram illustrating a configuration of an electronic magnetic contactor according to an exemplary embodiment of the present disclosure.

FIG. 2 is a schematic block diagram illustrating a configuration of an electronic magnetic contactor according to an exemplary embodiment of the present disclosure.

Referring to FIG. 2, the electronic magnetic contactor includes an operation power supply unit (100), an electronic switch driving unit (110), a switching unit (120) and an input determination unit (130).

The operation power supply unit (100) includes a surge absorption unit (104), a noise filter circuit unit (106) and a rectifying circuit unit (108). The electronic switch driving unit (110) includes a discharge circuit unit (112) and an electromagnetic coil (114), and the switching unit (120) includes a pulse width modulation unit (122), and a current sensing circuit unit (124). The input determination unit (130) includes an input voltage sensing unit (132), an input signal generation unit (134) and an operation state determination unit (136).

At this time, an operation power (102) may be a DC power or an AC power. The surge absorption unit (104) absorbs a surge voltage included in the operation power (102) and removes the surge voltage, and the noise filter circuit unit (106) removes noise included in the operation power removed of the surge voltage by the surge absorption unit (104).

The rectifying circuit unit (108) rectifies the power outputted by the noise filter circuit unit (106) and converts the power to a DC power.

The discharge circuit unit (112) and the electromagnetic coil (114) are connected in parallel, and one terminal of the parallel connection is connected to an output terminal of the rectifying circuit unit (108), and the other terminal of the parallel connection is connected to an input terminal of a current sensing circuit unit (124). The rectifying circuit unit (108) is configured to absorb counter electromotive force generated by the electromagnetic coil (114) while the operation power is turned off or the pulse width is modulated.

The pulse width modulation unit (122) generates a pulse signal having a predetermined width as a switching signal and receives a current flowing in the electromagnetic coil (114) detected by the current sensing circuit unit (124).

Meanwhile, the input voltage sensing unit (132) functions to sense amplitude of an input voltage, and the operation state determination unit (136) serves to determine an operation state of the electronic magnetic contactor. The input voltage sensed by the input voltage sensing unit (132), i.e., a sensing result of a voltage supplied by the operation power supply unit (100) and an operation state of the electronic magnetic contactor determined by the operation state determination unit (136), i.e., a result of whether the electronic magnetic contactor is in an open state or a closed state, are transmitted to the input signal generation unit (134).

The input signal generation unit (134) generates a signal for rendering the electronic magnetic contactor to be in an input state, and transmits the signal to the switching unit (120), where the switching unit (120) controls the electronic switch driving unit (110) and participates in the operation of the electronic magnetic contactor. An operation of the input determination unit (130), i.e., an operation related to the input voltage sensing unit (132), the input signal generation unit (134) and the operation state determination unit (136) will be described in detail in the following manner.

Figure 3:
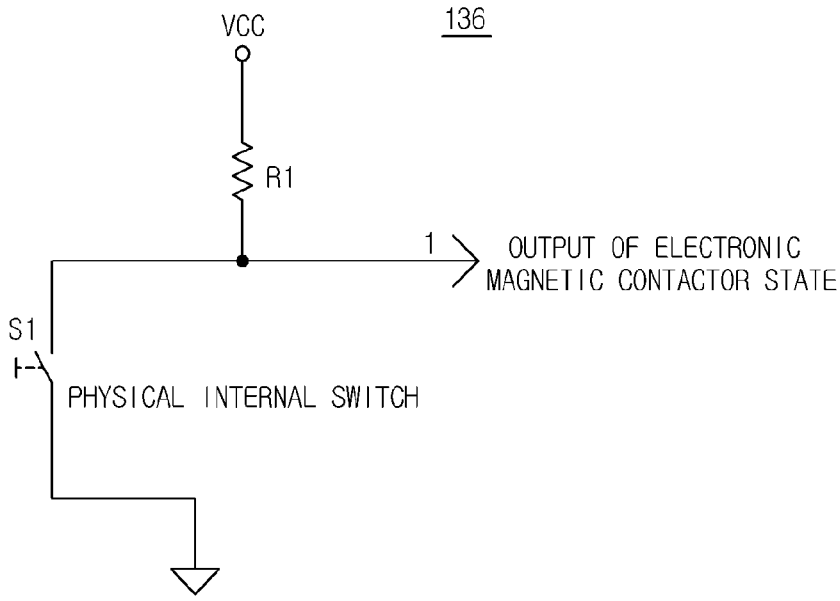
FIG. 3 is a circuit diagram illustrating a configuration of an operation state determination unit (136) as a constituent part of an electronic magnetic contactor according to an exemplary embodiment of the present disclosure.

FIG. 3 is a circuit diagram illustrating a configuration of an operation state determination unit (136) as a constituent part of an electronic magnetic contactor according to an exemplary embodiment of the present disclosure.

Referring to FIG. 3, the operation state determination unit (136) may include a physical internal switch (S1) and an internal resistor (R1). The physical internal switch (S1) operating in association with an OFF state and an ON state of the electronic magnetic contactor is connected to a minus (−) input of a comparator to have an H (1) input via the resistor (R1), in a case the physical internal switch (S1) is turned OFF, and to have a L (0) input via a ground, in a case the physical internal switch (S1) is turned ON.

A plus (+) input of the comparator is connected to a reference voltage, where the comparator compares the two inputs and sends an output, and has an H(1) output result, in a case the physical internal switch (S1) is turned OFF, and has a L(0) output result, in a case the physical internal switch (S1) is turned ON. Thus, a physical state of the electronic magnetic contactor can be checked, whereby an input signal can be generated by checking if the electronic magnetic contactor is turned OFF to make the electronic magnetic contactor in an ON state.

Figure 4A:
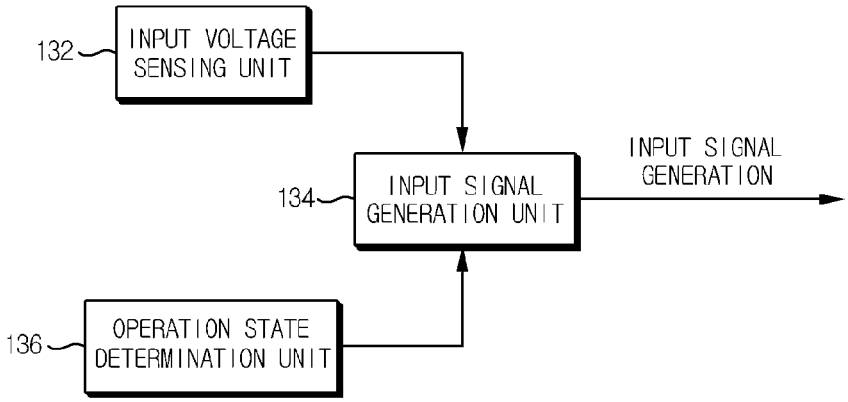
FIG. 4*a* is a schematic block diagram illustrating operations of an input voltage sensing unit, an input signal generation unit and an operation state determination unit as configurations of an electronic magnetic contactor according to an exemplary embodiment of the present disclosure.

FIG. 4*a* is a schematic block diagram illustrating operations of an input voltage sensing unit (132), an input signal generation unit (134) and an operation state determination unit (136) as configurations of an electronic magnetic contactor according to an exemplary embodiment of the present disclosure.

The input voltage sensing unit (132) includes a comparator and compares an input voltage rectified by the rectifying circuit unit (108) to a DC voltage with a reference voltage, and has an H (1) output result, in a case the input voltage is greater than the reference voltage, and has an L (0) output result, in a case the input voltage is smaller than the reference voltage.

Meanwhile, the operation state determination unit (136) includes the physical internal switch (S1) and the internal resistor (R1), and compares an input from the physical internal switch (S1) with the reference voltage, and outputs H (1), in a case the physical internal switch (S1) is OFF and outputs L (0), in a case the physical internal switch (S1) is ON.

The input signal generation unit (134) receives an output of the comparator of the input voltage sensing unit (132) and an output of the comparator of the operation state determination unit (136) respectively, and can prevent an erroneous operation by generating an input signal in a case at least one of the two outputs has an H (1) output result. To be more specific, in a case the input of the electronic magnetic contactor is determined only based on the input voltage, there is a chance of the input being realized in an improper manner in a case a discharge phenomenon is generated, and an erroneous operation caused by the discharge phenomenon generated by vibration or shock can be prevented.

Figure 4B:
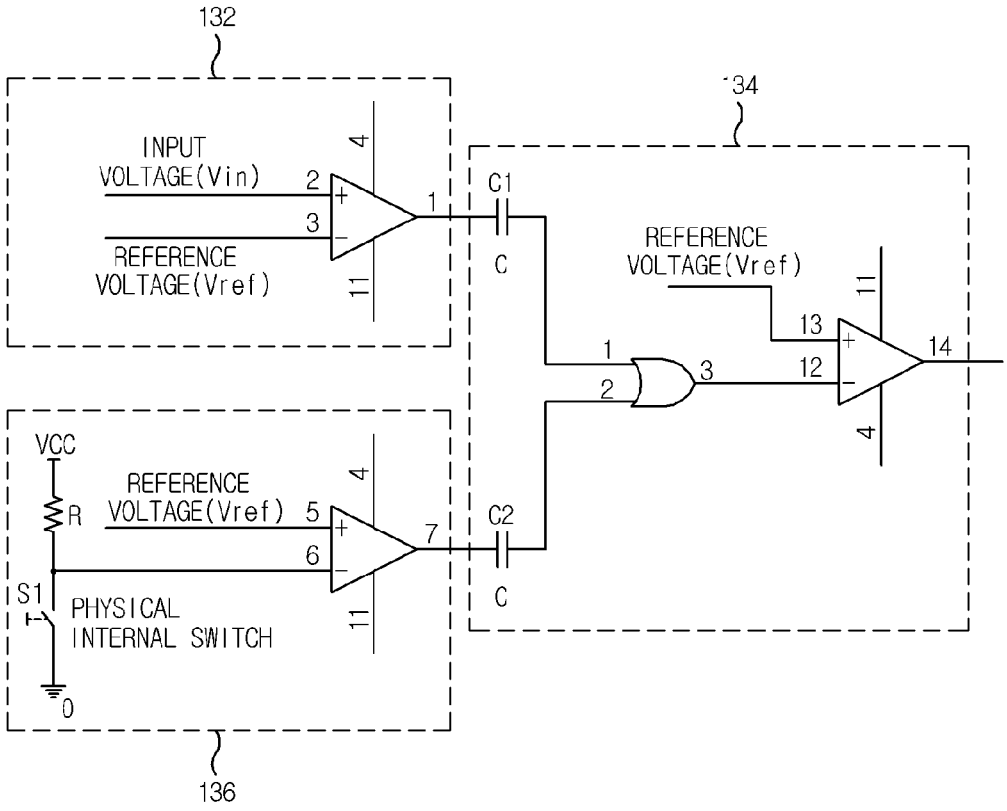
FIG. 4*b* is a schematic view illustrating a circuit configuration of FIG. 4*a*.

FIG. 4*b* is a schematic view illustrating in detail a circuit configuration of FIG. 4*a*.

The input voltage sensing unit (132) includes a comparator and has an input voltage (Vin) and a reference voltage (Vref). The input voltage (Vin) refers to a voltage supplied from the operation power supply unit (100), where the comparator has an H(1) output result, in a case the input voltage (Vin) is greater than the reference voltage (Vref), and has a L(0) output result, in a case the input voltage (Vin) is smaller than the reference voltage (Vref).

The operation state determination unit (136) includes a physical internal switch (S1), an internal resistor (R1) and a comparator, the detailed description of which will be omitted as it was explained in the foregoing of FIG. 3.

The input signal generation unit (134) includes two capacitors (C1, C2), an OR gate and a comparator. A comparator output of the input voltage sensing unit (132) and a comparator output of the operation state determination unit (136) are respectively connected to an input of the OR gate via the capacitors (C1, C2). The comparator output of the input voltage sensing unit (132) and the comparator output of the operation state determination unit (136) pass the capacitors (C1, C2), only when the comparator output of the input voltage sensing unit (132) and the comparator output of the operation state determination unit (136) are H(1) output results. A plus (+) input of the comparator of the input signal generation unit (134) is applied to an output terminal of the OR gate and a minus (−) input terminal of the comparator is applied to the reference voltage.

Even if the H(1) signal is generated by detecting the operation voltage of the input voltage sensing unit (132), and the electronic magnetic contactor is not in a close state, the physical internal switch (S1) detects the fact and provides the H(1) signal, such that the erroneous operation is not generated.

Figure 5:
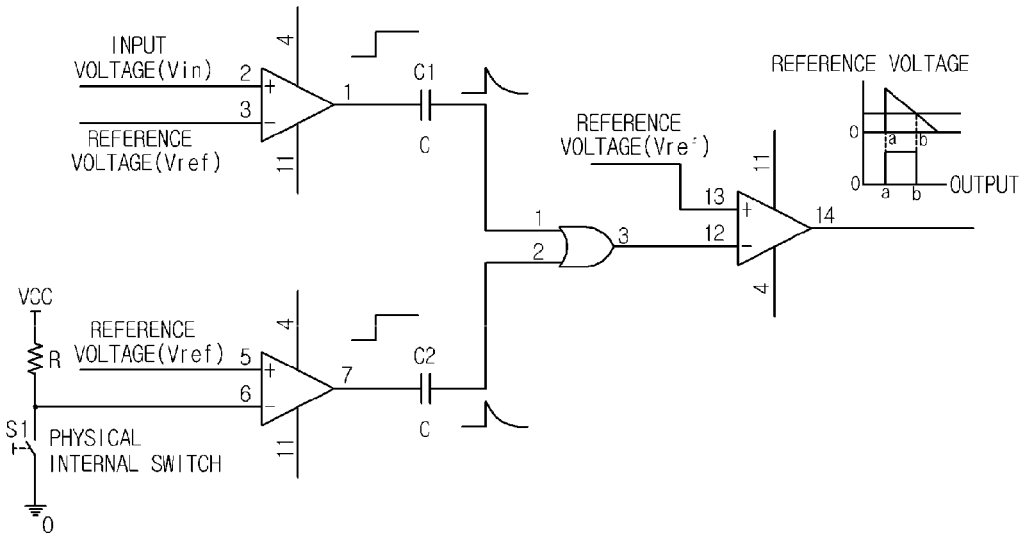
FIG. 5 is a schematic view illustrating an entire operation of an electronic magnetic contactor according to an exemplary embodiment of the present disclosure.

FIG. 5 is a schematic view illustrating an entire operation of an electronic magnetic contactor according to an exemplary embodiment of the present disclosure.

A detailed operation of the input voltage sensing unit (132), the input signal generation unit (134) and the operation state determination unit (136) has been already described in the foregoing, such that no redundant explanation will be omitted. Thus, description will be centered on input signal and output signal of the input voltage sensing unit (132), the input signal generation unit (134) and the operation state determination unit (136).

The input signal generation unit (134) generates an output signal by using, by the comparator, a signal outputted through the OR gate using the H(1) output result of the input voltage sensing unit (132) and the H(1) output result of the operation state determination unit (136). At this time, the signal outputted through the comparator maintains a H(1) from a to b. Thus, even if the output of the operation state determination unit (136) is changed to the L(0), the H(1) can be kept.

As apparent from the foregoing, the electronic magnetic contactor according to the present disclosure has an industrial applicability in that a power can be re-inputted by receiving (feedback) a state of the electronic magnetic contactor, the re-input is enabled even if a discharge phenomenon is generated by an external shock at a field site where vibration is severe, whereby a potential loss that may be generated at the factory automation system can be minimized.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims.

What is claimed is:

1. An electronic magnetic contactor, the contactor comprising: an operation power supply unit inputting an operation power; an electronic switch driving unit receiving a power from the operation power supply unit to drive a power supply of a load; a switching unit switched by a pulse signal to drive the electronic switch driving unit; an operation state determination unit determining whether the electronic magnetic contactor is in an opened state or in a closed state; an input voltage sensing unit sensing an amplitude of an input voltage supplied from the operation power supply unit; and an input signal generation unit generating an input signal for determining whether the electronic magnetic contactor is inputted based on the determined state by the operation state determination unit and the sensed amplitude by the input voltage sensing unit.

2. The electronic magnetic contactor of claim 1, wherein the operation state determination unit includes a comparator outputting a high output in a case the electronic magnetic contactor is in the opened state and outputting a low output in a case the electronic magnetic contactor is in the closed state.

3. The electronic magnetic contactor of claim 1, wherein the input voltage sensing unit compares an amplitude of the input voltage supplied by the operation power supply unit with an amplitude of a reference voltage to output a high output in a case the amplitude of the input voltage is greater than the amplitude of the reference voltage, and output a low output in a case the amplitude of the input voltage is smaller than the amplitude of the reference voltage.

4. The electronic magnetic contactor of claim 1, wherein the input signal generation unit includes an OR gate for determining whether at least one high output is outputted based on the determined state by the operation state determination unit and the sensed amplitude by the input voltage sensing unit; and a comparator for generating an input signal for determining whether the electronic magnetic contactor is inputted based on an output of the OR gate.

5. The electronic magnetic contactor of claim 4, wherein the input signal generation unit generates an input signal instructing an input of the electronic magnetic contactor in a case at least one high output is outputted in response to the determined state by the operation state determination unit and the sensed amplitude by the input voltage sensing unit.

6. The electronic magnetic contactor of claim 1, wherein the operation power supply unit includes a surge absorption unit absorbing a transient voltage, a noise filter circuit unit removing noise from an output of the surge absorption unit, and a rectifying circuit unit rectifying an output from a noise filter and supplying the rectified DC power to the switching unit.

7. The electronic magnetic contactor of claim 1, wherein the electronic switch driving unit further comprises: an electromagnetic coil interposed between the operation power supply unit and the switching unit to be driven by switching of the switching unit; and a discharge circuit unit connected to the electromagnetic coil in parallel to absorb counter electromotive force generated by the electromagnetic coil in a case the switching unit is turned off.

8. The electronic magnetic contactor of claim 1, wherein the switching unit includes a pulse width modulation unit generating a pulse signal, in a case a power is supplied to the load, and a current sensing circuit unit detecting a current flowing to the switching unit and outputting the detected current to the pulse width modulation unit, wherein the pulse width modulation unit varies a width of the pulse signal in response to the output of the current sensing circuit unit.

* * * * *